US005595850A

United States Patent [19]

Honjo et al.

[11] Patent Number: 5,595,850

[45] Date of Patent: Jan. 21, 1997

[54] FERRITE CARRIER FOR ELECTROPHOTOGRAPHIC DEVELOPER AND DEVELOPER CONTAINING THE CARRIER

[75] Inventors: Toshio Honjo; Yuji Sato; Kanao Kayamoto; Masahiro Ogata; Hiromichi Kobayashi, all of Kashiwa, Japan

[73] Assignee: Powdertech Co., Ltd., Chiba-ken, Japan

[21] Appl. No.: 496,023

[22] Filed: Jun. 28, 1995

[30] Foreign Application Priority Data

Jul. 5, 1994 [JP] Japan ..... 6-174909

[51] Int. Cl.[6] ..... G03G 9/107

[52] U.S. Cl. ..... 430/106.6; 430/108; 252/62.63

[58] Field of Search ..... 430/106, 108; 252/62.63

[56] References Cited

U.S. PATENT DOCUMENTS

| | | | |
|---|---|---|---|
| 5,096,797 | 3/1992 | Yoerger | 430/108 |
| 5,268,249 | 12/1993 | Saha et al. | 430/108 |
| 5,306,592 | 4/1994 | Saha . | |

FOREIGN PATENT DOCUMENTS

| | | |
|---|---|---|
| 0351712 | 1/1990 | European Pat. Off. . |
| 59-111159 | 6/1984 | Japan . |

*Primary Examiner*—John Goodrow
*Attorney, Agent, or Firm*—Morrison Law Firm

[57] ABSTRACT

A ferrite carrier for electrophotographic developers which comprises a Mn-Mg ferrite having the general formula $$(MnO)_x(MgO)_y(Fe_2O_3)_z$$

wherein x+y+z=100 mol % and SrO is substituted for a part of MnO, MgO and/or $Fe_2O_3$.

14 Claims, No Drawings

FERRITE CARRIER FOR ELECTROPHOTOGRAPHIC DEVELOPER AND DEVELOPER CONTAINING THE CARRIER

BACKGROUND OF THE INVENTION

1. Field of the Invention

This invention relates to a carrier for two-component electrophotographic developers and to a developer containing the carrier for use in copy machines, printers and the like.

2. Prior Art

Two-component developers used in electrophotography typically contain a toner and carrier. The carrier is such that it is mixed and agitated with the toner in a development box to impart a desired electrostatic charge to the toner particles. The charged toner is carried to static latent images on a photosensitive material to form corresponding toner images.

The carrier remains on a magnet and is recycled to the development box where the recycled carrier is again mixed and agitated with a fresh toner for repeated use.

Therefore, a carrier used in a developer is required as a matter of course to be unchanged and stable in characteristics and properties during its service period of time in order to enable the resulting developer to maintain its desired image-developing properties (such as image density, fog, white spots or carrier scattering, gradation, and resolution) with minimal change and maximum stability not only at its initial stage of use but also during its entire period of use or service life.

In the recent development system using a two-component developer, soft ferrites have been used as a carrier in place of conventional oxide-coated iron powder or resin-coated iron powder to obtain images of high quality. Typical of the soft ferrites are $MO_a \cdot M'O_b\ (Fe_2O_3)_x$ wherein M and M' are each a metal element; and a, b and x are each an integer (The integer is a member like 1, 2, 3, 4 etc. A better way is to indicate x+a+b=1 (mol fraction)). Examples of the soft ferrites are Ni-Zn ferrite, Mn-Zn ferrite and Cu-Zn ferrite.

These soft ferrite carriers have many favorable properties for providing images of high quality as compared with iron powder carriers conventionally used; however, the use, in these carriers, of metals such as Ni, Cu and Zn has come to be avoided under rigorous environmental restrictions in recent years.

In view of environmental advantages, iron powder and magnetite powder carriers seem to be favorable. It is, however, difficult with these carriers to obtain an image quality and lifetime comparative to those obtained with the above mentioned soft ferrite carriers. From this standpoint, the ferrite carriers have been used widely, permitting their lifetime to be long as compared with the iron powder carrier. A further longer lifetime, however, has been desired.

From the viewpoint of environmental advantages, Li-Mn ferrites seem to be favorable among the ferrite carriers that have conventionally been proposed. Lithium, however, has not been used in practice because it is liable to be affected by its surroundings of, for example, temperature and humidity whereby it greatly varies in properties. Further, although Mn-Mg based ferrites have been proposed, it is not achieved yet at present similarly to conventionally-used ferrite carriers to solve problems which reduce dispersion of magnetization of said Mn-Mg based ferrite carrier particles.

SUMMARY OF THE INVENTION

An object of the present invention is to overcome the above mentioned problems and provide ferrite carriers for use in an electrophotographic developer which are useful in forming images of high quality, are superior in durability, are environmentally benign, have a long lifetime and are superior in environmental stability, by reducing the magnetization dispersion of the ferrite carrier particles.

The present inventors had made intensive studies to overcome said problems and, as the result of their studies, they have found that the above mentioned object can be achieved by substituting a predetermined amount of strontium oxide (SrO) for a part of a Mn-Mg ferrite having a specific composition. The present invention was thus completed.

The present invention will now be explained hereunder in more detail.

A ferrite carrier for an electrophotographic developer according to the present invention is a Mn-Mg ferrite characteristically having the following general formula $$(MnO)_x(MgO)_y(Fe_2O_3)_z$$

wherein x+y+z=100 mol % and SrO is substituted for a part of MnO, MgO and/or $Fe_2O_3$.

In the above general formula, the sum of x+y+z is 100 mole % and it is preferable as a basic composition that x, y and z be 35 to 45 mol %, 5 to 15 mol % and 45 to 55 mol %, respectively. Further, SrO is substituted for a part of the MnO, MgO and/or $Fe_2O_3$ in the present invention. The amount of SrO substituted is preferably from 0.35 to 5.0 mol %.

It is not disirable that the amount of SrO substituted is less than 0.35 mol % since magnetization of the scattered ferrite is reduced and that the amount of SrO substituted is more than 5.0 mol % since residual magnetization and coercive force generate in the ferrite thereby to cause agglomeration of the ferrite carrier particles. Thus, if the amount of SrO substituted is within the range of from 0.35 to less than 5.0 mol %, this substitution will make it possible to reduce the magnetization dispersion of the resulting ferrite carrier particles and thereby to obtain carriers which are excellent in enhancement of the image-developing capability of the resulting developer, durability, environmental benignness, long service life and environmental stability.

As compared with iron powder carrier and magnetite carrier, the novel ferrite carrier according to the present invention useful in effecting soft development since the novel carrier suffers low magnetization and ears of a magnetic brush become soft. In addition, a high image quality can be obtained due to a high dielectric breakdown voltage and the like.

The ferrite carrier according to the present invention has an average particle diameter in the range of from about 15 to about 200 μm, preferably from 20 to 150 μm, and more preferably from 20 to 100 μm. The average particle diameter of smaller than 15 μm increases a proportion of fine powder in the carrier particle distribution, decreasing the magnetization per one particle and causing carrier scattering when the carrier is used in development. The average carrier particle diameter of larger than 200 μm reduces a specific surface area of the carrier. Such a particle diameter is not preferable because the toner scattering is caused upon development and the reproducibility of a black solid portion is deteriorated.

The ferrite carrier according to the present invention has a resistivity in the range of from $10^7$ to $10^{14}$ Ω·cm, preferably from $10^9$ to $10^{13}$ Ω·cm. Further, the ferrite carrier according to the present invention has a saturated magnetization in the range of from 20 to 75 emu/g, preferably from 30 to 75 emu/g.

A method of producing the ferrite carrier of the present invention is described briefly.

MnO, MgO and $Fe_2O_3$ are collected together in such amounts that the resultant Mn-Mg ferrite has a composition consisting of amounts of from 35 to 45 mol %, 5 to 15 mol % and 45 to 55 mol % in that order, respectively, and the resulting mixture is further mixed with a predetermined amount of SrO or $SrCO_3$ which is to be converted finally into SrO, after which the mass so obtained is usually incorporated with water and then ground and mixed over a period of at least 1 hour, preferably 1–20 hours, on a wet ball mill, a wet vibration ball mill or the like. The slurry so obtained is dried, further ground and subjected to calcining at a temperature of from 700° to 1200° C. If a lower apparent density of the resulting carriers is desired, the calcining may be omitted. The calcined is further ground into particles of 15 μm or smaller, preferably 5 μm or smaller, and more preferably 2 μm or smaller, in the wet ball mill, the wet oscillation mill, or the like, subsequently incorporated with a dispersing agent, a binder and the like, adjusted in viscosity and then granulated. The particles so obtained are kept for 1 to 24 hours at a temperature of from 1000° to 1500° C. for final firing.

The thus finally fired particles are disintegrated and classified. If necessary, these particles may be somewhat reduced and then re-oxidized at the surface at a low temperature.

Next, the surface of the SrO-substituted Mn-Mg ferrite carrier so obtained according to the present invention is coated with a resin. The resin used for coating the ferrite particles of the present invention may be any one of various resins. The resins applicable to toners of positive charge include fluororesins, fluoroacrylic resins, and silicone resins. The resin for this purpose is preferably a silicone resin of a condensation type. The resins applicable to toners of negative charge include acryl-styrene resins, mixed resins of an acryl-styrene resin and melamine resin and hardening resins thereof, silicone resins, silicone acryl denatured resins, epoxy resins, and polyester resins. The resin for this purpose is preferably a hardening resin of an acryl-styrene resin and melamine resin, and a silicone resin of the condensation type. In addition, a charge control agent or a resistance control agent may be added if necessary.

The amount of the resin coated is preferably From 0.05% to 10.0% by weight, and more preferably from 0.1% to 7.0% by weight relative to the carrier which is a core material in this case. A uniform coating layer cannot be formed on the carrier surface when less than 0.05% by weight of the resin is used. The coating layer becomes excessively thick when more than 10.0% by weight of the resin is used. This may cause coagulation between the carrier particles, restricting production of uniform carrier particles.

In a typical method of resin coating, the resin is diluted in a solvent and then coated on the surface of the carrier core. The solvent used for this purpose may any one of adequate resin-soluble solvents. For a resin soluble in an organic solvent, these may be used a solvent such as toluene, xylene, Cellosolve butyl acetate, methyl ethyl ketone, methyl isobutyl ketone, or methanol. For a water-soluble resin or an emulsion type resin, water may be used as the solvent. The resin diluted with the solvent is coated on the surface of the carrier core through any one of adequate methods including dip coating, spray coating, brush coating, and kneading coating. The solvent is then volatilized from the surface. A resin in the form of powder may be applied to the surface of the carrier core through a dry method rather than the wet method using a solvent.

The carrier core coated with the resin is baked, if necessary, through either external heating or internal heating by using, for example, a fixed-bed electric furnace, a fluidized-bed electric furnace, a rotary electric furnace, or a burner furnace. Alternatively, the resin may be baked with microwaves. The baking temperature, which varies depending on the resin used, is required to be equal to or higher than the melting point or the glass transition point of the resin. If a thermoset resin or a condensation resin is used for coating, it should be heated to such a temperature at which sufficient level of hardening can be achieved.

The carrier core is coated with the resin and baked, chilled, disintegrated and then adjusted in particle size to obtain a resin-coated carrier.

The ferrite carrier according to the present invention is mixed with a toner for use as a two-component developer. The toner used herein is such that a coloring agent or the like is dispersed in a bonding resin. The bonding resin used for the toner is not particularly limited. Examples of the bonding resin are polystyrene, chloropolystyrene, styrene-chlorostyrene copolymers, styrene-acrylic acid ester copolymers, styrene-methacrylate copolymers, rosin-denatured maleic acid resins, epoxy resins, polyester resins, polyethylene resins, polypropylene resins and polyurethane resins. These resins may be used alone or jointly.

The charge control agent which may be used in the present invention may be any one of adequate ones. For the toner of positive charge, examples of the usable charge control agent are nigrosine dyes, and quaternary ammonium salts. For the toner of negative charge, metal-containing monoazo dyes and the like may be used.

Coloring agents usable herein may be conventionally known dyes and/or pigments. For example, the coloring agent may be carbon black, phthalocyanine blue, permanent red, chrome yellow or phthalocyanine green. The content of the coloring agent may be from 0.5% to 10% by weight relative to 100% by weight of the bonding resin. Additives such as fine powder of silica and titania may be added to the toner particles depending thereon to improve the toner in fluidity or anti-coagulating property.

A method of producing the toner is not particularly limited. The toner may be obtained by mixing together, for example, the bonding resin, the charge control agent, and the coloring agent sufficiently in a mixer such as a Henschel mixer, melt kneading the mixture through, for example, a biaxial extruder, chilling the kneaded mixture, grinding the chilled mixture, classifying the ground mixture, incorporating the additives therein and then mixing the whole in a mixer or the like.

DESCRIPTION OF THE PREFERRED EMBODIMENTS

The present invention will be better understood by the following Examples and Comparative Examples.

Examples 1–3

35.0 mol % of MnO, 15.0 mol % of MgO, 44.5 mol % of $Fe_2O_3$ and 0.5 mol % of $SrCO_3$ were ground and mixed on a wet ball mill over a period of 5 hours. The thus obtained mixture was dried and calcined at 850° C. for 1 hour. The thus preliminarily fired product was ground on a wet ball mill over a period of 7 hours to obtain a slurry containing the fired product particles which had an average particle diameter of 3 μm. The slurry so obtained was incorporated with suitable amounts of a dispersing agent and a binder, thereafter granulated and dried through a spray drier and then finally fired at 1200° C. for 4 hours in an electric furnace. Subsequently, the granules so finally fired were disaggregated and then classified to obtain ferrite core particles having an average particle diameter of 50 μm or a particle diameter distribution of 30–70 μm.

The ferrite core particles thus obtained were subjected to composition analysis. As a result, these core particles had a composition of 35 mol % of MnO, 14.5 mol % of MgO, 0.5 mol % of SrO and 50 mol % of $Fe_2O_3$ (Example 1).

The procedure of Example 1 was followed except that the respective amounts of SrO used and the site of substitution in the other two Examples were not quite the same as in Example 1, thereby to obtain Mn-Mg ferrite carriers (Examples 2 and 3) having the respective compositions shown in Table 1.

Using these ferrite particles as the cores, a silicone resin (trade name SR-2411; 20 wt. % solid; manufactured by Dow Corning Toray Silicone Co., Ltd.) was dissolved in toluene as the solvent, coated on the ferrite cores in an amount of 0.6% by weight by using a fluidized-bed and then subjected to baking at 250° C. for 3 hours, thereby to obtain ferrite carriers coated with the above mentioned resin.

The Mn-Mg ferrite carriers so coated with the resin were subjected to a test for their amount scattered.

The amount of the carrier scattered was tested in the following manner: 600 g of the sample were placed in a development box in a Leodry 7610 copier manufactured by Toshiba Co. The sample was agitated and stirred for 10 minutes by using a motor at a rotation speed of 158 rpm. A portion of the sample which was scattered out of the development box during the agitation, was recovered and weighed to find the amount of the portion scattered and the magnetization thereof at 1 KOe. The dispersion of magnetization of the ferrite carrier particles is evaluated by a ratio of Y/X wherein the magnetization of the carrier perticles before testing the amount thereof scattered is regarded as X and the magnetization of the scattered carrier particles is regarded as Y.

The results thus found are shown in Table 1.

Comparative Examples 1–3

The same procedure as that in Example 1 was followed except that SrO was not used as a substituent and the amounts (in mol %) of the starting metal oxides used were not quite the same as those used in Example 1, thereby to obtain comparative Mn-Mg ferrite core materials having the respective compositions shown in Table 1.

These ferrite core material particles so obtained were used as the cores and coated with the same resin as used in Example 1. The resin was coated on the particles in the same amount and in the same manner as in Example 1. The resin-coated particles were baked to obtain resin-coated ferrite carriers.

The resin-coated Mn-Mg ferrite carriers were subjected to a test for the amount thereof scattered in the same manner as in Example 1.

The results thus obtained are shown in Table 1.

Comparative Examples 4–7

The procedure of Comparative Examples 1–3 was followed except that SrO was not used as a substituent and BaO, CaO, $SiO_2$ and $Al_2O_3$ were used as substituents respectively in Comparative Examples 4–7, thereby to obtain comparative Mn-Mg ferrite core materials having the respective compositions shown in Table 1.

The ferrite core material particles so obtained were used as a core and coated with the same resin as used in Example 1, thereby to obtain resin-coated Mn-Mg ferrite carriers.

The resin-coated Mn-Mg ferrite carriers were subjected to a test for the amount thereof scattered in the same manner as in Example 1.

The results thus obtained are shown in Table 1.

Comparative Example 8

The same procedure as used in Example 1 was followed except that SrO was not used as a substituent, thereby to obtain a Cu-Zn ferrite carrier core material having the composition shown in Table 1.

Comparative Example 9

The same procedure as in Example 1 was followed except that SrO was not used as a substituent, thereby to obtain a Ni-Zn ferrite carrier core material having a composition as shown in Table 1.

Comparative Example 10

The same procedure as used in Example 1 was followed except that SrO was not used as a substituent, thereby to obtain a Mg-Cu-Zn ferrite carrier core material having a composition as shown in Table 1.

Comparative Examples 11–12

The same procedure as used in Example 1 was followed except that SrO was not used as a substituent, thereby to obtain Li ferrite carrier core materials respectively having the compositions shown in Table 1 (Comparative Examples 11–12).

These ferrite core material particles so obtained in Comparative Examples 8–12 were used as the cores and coated with the same resin as used in Example 1. The resin was coated on the particles in the same amount and in the same manner as in Example 1. The resin-coated particles were baked to obtain resin-coated ferrite carriers.

The resin-coated ferrite carriers thus obtained were subjected to a test for the amount thereof scattered in the same manner as in Example 1 (Comparative Examples 8–12).

The results thus obtained are shown in Table 1.

TABLE 1

| No. | Composition (mol %) MnO | MgO | CuO | ZnO | $Li_2O$ | NiO | SrO | BaO | CaO | $SiO_2$ | $Al_2O_3$ | $Fe_2O_3$ | scattered amount of carrier (mg) | magnetization before test X (emu/g) | magnetization of scattered carrier Y (emu/g) | Y/X |
|---|---|---|---|---|---|---|---|---|---|---|---|---|---|---|---|---|
| Ex. 1 | 35 | 14.5 | | | | | 0.5 | | | | | 50 | 6 | 54.0 | 54.0 | 1.0 |
| Ex. 2 | 35 | 10.3 | | | | | 4.7 | | | | | 50 | 5 | 52.0 | 52.0 | 1.0 |
| Ex. 3 | 40 | 10 | | | | | 0.4 | | | | | 49.6 | 4 | 58.0 | 58.0 | 1.0 |
| Comp. Ex. 1 | 30 | 20 | | | | | | | | | | 50 | 15 | 52.0 | 18.5 | 0.356 |
| Comp. Ex. 2 | 35 | 15 | | | | | | | | | | 50 | 23 | 54.0 | 22.5 | 0.417 |
| Comp. Ex. 3 | 40 | 10 | | | | | | | | | | 50 | 27 | 55.0 | 25.0 | 0.455 |
| Comp. Ex. 4 | 35 | 14.5 | | | | | | 0.5 | | | | 50 | 27 | 54.0 | 21.0 | 0.389 |
| Comp. Ex. 5 | 35 | 14.5 | | | | | | | 0.5 | | | 50 | 46 | 53.0 | 6.0 | 0.113 |
| Comp. Ex. 6 | 35 | 14.5 | | | | | | | | 0.5 | | 50 | 166 | 53.0 | 2.0 | 0.038 |
| Comp. Ex. 7 | 35 | 14.5 | | | | | | | | | 0.5 | 50 | 12 | 53.0 | 45.5 | 0.858 |
| Comp. Ex. 8 | | | 20 | 25 | | | | | | | | 55 | 152 | 60.0 | 53.0 | 0.883 |
| Comp. Ex. 9 | | | | 37 | | 13 | | | | | | 50 | 29 | 49.0 | 34.5 | 0.704 |
| Comp. Ex. 10 | | 11 | 9 | 30 | | | | | | | | 50 | 205 | 48.0 | 38.0 | 0.791 |
| Comp. Ex. 11 | | | | | 13.8 | | | | | | | 86.2 | 531 | 59.0 | 9.0 | 0.153 |
| Comp. Ex. 12 | | | | | 16.7 | | | | | | | 83.3 | 36 | 60.0 | 20.0 | 0.333 |

As will be understood from the results shown in Table 1, the amounts of the scattered ferrite carriers according to this invention obtained by substituting a predetermined amount of SrO for a portion of Mn-Mg ferrites respectively having specific compositions are extremely small as compared with those of Comparative Examples 1–12. In addition, from the magnetization values of the carriers before the test for the amounts thereof scattered and those of the scattered carrier, it is apparent that the dispersion of the carrier particles is hardly appreciated.

Effects of the Invention

As mentioned above, according to this invention, there can be obtained a ferrite carrier for electrophotographic developers, which is obtained by substituting a part of a Mn-Mg ferrite having a specific composition with a predetermined amount of SrO and in which the amount of the ferrite carrier scattered is extremely small as compared with the conventional SrO-free Mn-Mg, Cu-Zn, Ni-Zn and Mg-Cu-Zn ferrite carriers and the magnetization dispersion of the carrier particles is hardly found. In addition, the Mn-Mg ferrite carrier for the electrophotographic developers according to the present invention permits a wide range of choice of design to obtain desired image properties upon development, and is capable of coping with rigorous environmental restrictions.

What is claimed is:

1. A ferrite carrier for electrophotographic developers which comprises a Mn-Mg ferrite having the general formula $$(MnO)_x(MgO)_y(Fe_2O_3)_z$$

wherein x+y+z=100 mol % and SrO is substituted for a part of the MnO, MgO and/or $Fe_2O_3$; and said Mn-Mg ferrite is formed by the method comprising a first step mixing MnO, MgO, and $Fe_2O_3$ with a predetermined amount of SrO or $SrCO_3$ to form a mixture, a second step of grinding and mixing said mixture with water to form a slurry, a third step of drying said slurry to form a dried slurry product, a fourth step of grinding and incorporating said dried slurry product with a dispersing agent and a binder to form an incorporated product, a fifth step of granulating said incorporated product to form a multitude of particles, and a sixth step of maintaining said multitude of particles at a temperature of from about 1000° C. to about 1500° C. for about 1 hour to about 24 hours.

2. A ferrite carrier according to claim 1, wherein said x, y and z stand for 35 to 45 mol %, 5 to 15 mol % and 45 to 55 mol %, respectively.

3. A ferrite carrier according to claim 2, wherein in the general formula, the amount of SrO substituted is from 0.35 to 5.0 mol %.

4. A ferrite carrier according to claim 1, wherein the surface of said ferrite carrier is coated with a resin.

5. An electrophotographic developer comprising a toner and a ferrite carrier comprising a Mn-Mg ferrite having the general formula $$(MnO)_x(MgO)_y(Fe_2O_3)_z$$

wherein x+y+z=100 mol % and SrO is substituted for a part of the MnO, MgO and/or $Fe_2O_3$; and said Mn-Mg ferrite is formed by the method comprising a first step mixing MnO, MgO, and $Fe_2O3$ with a predetermined amount of SrO or SrCO3 to form a mixture, a second step of grinding and mixing said mixture with water to form a slurry, a third step of drying said slurry to form a dried slurry product, a fourth step of grinding and incorporating said dried slurry product with a dispersing agent and a binder to form an incorporated product, a fifth step of granulating said incorporated product to form a multitude of particles, and a sixth step of maintaining said multitude of particles at a temperature of from about 1000° C. to about 1500° C. for about 1 hour to about 24 hours.

6. An electrophotographic developer according to claim 5, wherein the surface of said ferrite carrier is coated with a resin.

7. A ferrite carrier according to claim 1, wherein said carrier has an average particle diameter in the range of from about 15 μm to about 200 μm.

8. A ferrite carrier according to claim 1, wherein said carrier has a resistivity in the range of from about $10^7$ Ω·cm to about $10^{14}$ Ω·cm.

9. A ferrite carrier according to claim 1, wherein said carrier has a saturated magnetization in the range of from about 20 emu/g to about 75 emu/g.

10. A ferrite carrier according to claim 4, wherein said resin is a member selected from the group consisting of fluororesin, fluoroacrylic resin, and silicone resin.

11. A ferrite carrier according to claim 4, wherein said resin is a member selected from the group consisting of acryl-styrene resin, silicone resin, silicone acryl denatured resin, epoxy resin, polyester resin, and mixed three component resin of acryl-styrene resin mixed with melamine resin mixed with hardening resin.

12. A ferrite carrier according to claim 4, wherein said resin is from about 0.05% by weight to about 10.0% by weight relative to said ferrite carrier.

13. A ferrite carrier according to claim 1, wherein said third step of drying is followed by a seventh step of grinding and calcining at a temperature of from about 700° C. to about 1200° C. prior to said fourth step.

14. An electrophotographic according to claim 5, wherein said third step of drying is followed by a seventh step of grinding and calcining at a temperature of from about 700° C. to about 1200° C. prior to said fourth step.

* * * * *